United States Patent [19]

Ozawa

[11] Patent Number: 4,621,652

[45] Date of Patent: Nov. 11, 1986

[54] APPARATUS FOR REMOVING SCALE FROM NUCLEAR FUEL RODS

[75] Inventor: Tamotsu Ozawa, Yokohama, Japan

[73] Assignee: Tokyo Shibaura Denki Kabushiki Kaisha, Kanagawa, Japan

[21] Appl. No.: 532,965

[22] Filed: Oct. 21, 1983

Related U.S. Application Data

[62] Division of Ser. No. 323,126, Nov. 19, 1981, Pat. No. 4,461,650.

[30] Foreign Application Priority Data

Nov. 26, 1980 [JP] Japan ..... 55-166378

[51] Int. Cl.[4] ..... B08B 5/00

[52] U.S. Cl. ..... 134/95; 134/104; 134/109; 252/626; 376/310

[58] Field of Search ..... 376/309, 310, 316; 252/626; 134/95, 104, 109

[56] References Cited

U.S. PATENT DOCUMENTS

| | | | |
|---|---|---|---|
| 2,887,373 | 5/1959 | Winkler et al. | 376/309 X |
| 3,013,909 | 12/1961 | Pancer et al. | 376/309 X |
| 3,375,169 | 3/1968 | McHugh et al. | 376/305 X |
| 3,382,046 | 5/1968 | Faugeras et al. | 134/104 |
| 3,638,666 | 2/1972 | Fishman | 134/95 |
| 3,664,870 | 5/1972 | Oberhofer et al. | 376/309 X |
| 3,714,323 | 1/1973 | Dolci et al. | 423/4 |
| 3,984,345 | 10/1976 | Heylen et al. | 252/626 X |
| 4,058,412 | 11/1977 | Knapp et al. | 134/104 |
| 4,089,122 | 5/1978 | Gust et al. | 134/104 |
| 4,294,805 | 10/1981 | Hodgson et al. | 252/626 X |
| 4,470,951 | 9/1984 | Bradbury et al. | 376/310 |

FOREIGN PATENT DOCUMENTS

| | | | |
|---|---|---|---|
| 54-134299 | 10/1979 | Japan | 252/626 |

*Primary Examiner*—Edward A. Miller

*Attorney, Agent, or Firm*—Stevens, Davis, Miller & Mosher

[57] ABSTRACT

A boiling water type nuclear fuel rod assembly used in a nuclear reactor and having radioactive scale deposited thereon is taken out of a fuel pool and disposed in a substantially sealed vertical tank, while the scale is still wetted by water. Gas in the tank is heated to a temperature higher than room temperature by the heat of nuclear fission or an electric heater to dry and peel off the scale. A mixture of the scale and water collected in a bottom portion of the tank is sent to a water-scale separator. To rapidly and perfectly remove the scale, after completing the step described above, water is sprayed onto the fuel rod assembly to wet any remaining scale. Then, drying of the scale with hot gas is repeated again.

13 Claims, 3 Drawing Figures

APPARATUS FOR REMOVING SCALE FROM NUCLEAR FUEL RODS

This is a division of application Ser. No. 323,126, filed Nov. 19, 1981 now U.S. Pat. No. 4,461,650.

BACKGROUND OF THE INVENTION

This invention relates to an apparatus for removing scale consisting essentially of $Fe_2O_3$ and deposited on the surfaces of fuel rods which are arranged in grid form to constitute a fuel rod assembly. In the art of a boiling water type nuclear reactor such scale is usually termed a "clud".

As is well known in the art, in a boiling water type nuclear reactor, a reactor core comprising a plurality of fuel rod assemblies and equipped with control rods is disposed in a pressure vessel, and water acting as a coolant and decelerating medium is circulated through the core to generate steam.

As shown in FIG. 1, a typical fuel rod assembly 6 comprises tubular sheaths 20 with their upper and lower ends sealed by upper end plugs 18 and lower end plugs 19 respectively, and pellet shaped fissionable fuels 21 are contained in each sheath 20. Each lower end plug 19 is tapered to be supported in vertical alignment by a supporting opening 22 provided for a lower tie plate 14 while each upper end plug 18 has an extension 23 received in a supporting opening 24 extending through an upper tie plate 15.

Some of the supporting openings 22 of the lower tie plate 14 are provided with screw threads for receiving fuel rods 16 provided with threaded lower end plugs 19. An extension 23 of the upper end plug 18 of each fuel rod 16 extends upwardly through the supporting opening 24 of the upper tie plate 15, and a holding nut is threaded onto the upper end of each extension 23 so as to assemble the upper and lower tie plates 14 and 15 and the fuel rods 16 into an integral fuel assembly 6. The spacings between fuel rods 16 are maintained by a plurality of spacers 17.

The fuel assembly 6 is housed in a channel 26, shown in FIG. 1, having a square cross-section. A clip 27 having a perforation is welded to the upper end of the channel 26 so as to connect the channel 26 to the tie plate 15 with a bolt extending through the clip 27. When the nut is removed from the bolt, the channel 26 can be readily mounted and dismounted while sliding along the upper and lower tie plates 14 and 15 and spacers 17.

During the operation of a nuclear reactor, a large quantity of cooling water is circulated through the spaces between respective fuel rods.

Although the cooling water is used for the purpose of decelerating neutrons and transmitting the heat generated, it is circulated together with a corrosive product (scale) generated by the internal structure of the nuclear reactor. Since the fuel rods are at the highest temperature among various internal structures they adsorb most of the scale formed. Consequently, scale will accumulate with time on the surfaces of the fuel rods to decrease the rate of heat transfer thus causing the surface temperature to rise.

When transferring and treating a fuel assembly in which a large quantity of scale has been deposited on the surfaces of the fuel rods to a working factory, the transfer and treatment of the rods should be made very carefully because the deposited scale is highly radioactive.

Although the cooling water is highly purified before use, it still contains a certain amount of impurities that form scale.

One approach to this problem is to strictly control the quality of cooling water so as not to convey the scale into the reactor core, but since a large quantity of scale is generated by the internal structure it is impossible to prevent deposition of the scale on the surfaces of the fuel rods.

Accordingly, the only remaining measure is to periodically remove the scale, but since the scale is highly radioactive it is necessary to carefully and safely remove the scale and to safely discard the removed scale.

SUMMARY OF THE INVENTION

Accordingly, it is an object of this invention to provide a novel method apparatus for readily and efficiently removing scale from the surfaces of nuclear fuel rods.

According to another aspect of this invention, there is provided apparatus for removing scale which is deposited on a nuclear fuel rod assembly during operation of the nuclear fuel rod assembly in a boiling water type nuclear reactor, comprising a substantially sealed tank in which the nuclear fuel rod assembly is disposed, means for wetting the scale with water while the fuel rod assembly is within the tank, means for filling the tank with a gas heated to a temperature higher than room temperature for drying and peeling off the scale from the nuclear fuel rod assembly, and means connected to a bottom portion of the tank for separating peeled off scale and water discharged from the tank.

According to a modification of this invention, there is provided apparatus for removing scale which is deposited on a nuclear fuel assembly during operation of the nuclear fuel rod assembly in a nuclear reactor, comprising a substantially sealed vertical tank in which the nuclear fuel rod assembly is disposed, means for wetting the scale with water while the fuel rod assembly is within the tank, means for filling the tank with a gas heated to a temperature higher than room temperature for drying and peeling off the scale from the nuclear fuel rod assembly, means connected to a bottom portion of the tank for separating peeled off scale and water discharged from the tank and means for spraying water onto the nuclear fuel rod assembly in the tank the scale has been removed.

Preferably, the peeling off of the scale with the heated gas and spray of water are alternately performed for a predetermined number of cycles for rapidly and completely removing the scale.

DESCRIPTION OF THE PREFERRED EMBODIMENT

Figure 1:
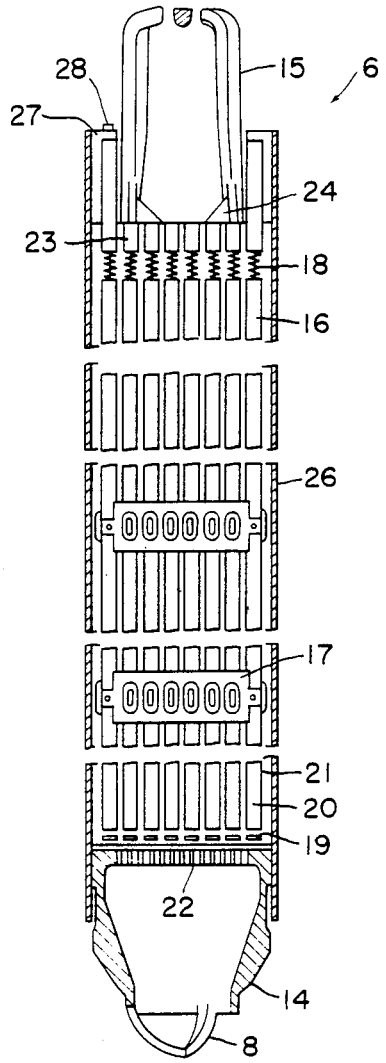
FIG. 1 PRIOR ART
FIG. 1 is a longitudinal sectional view showing a typical prior art nuclear fuel rod assembly.
Figure 2:
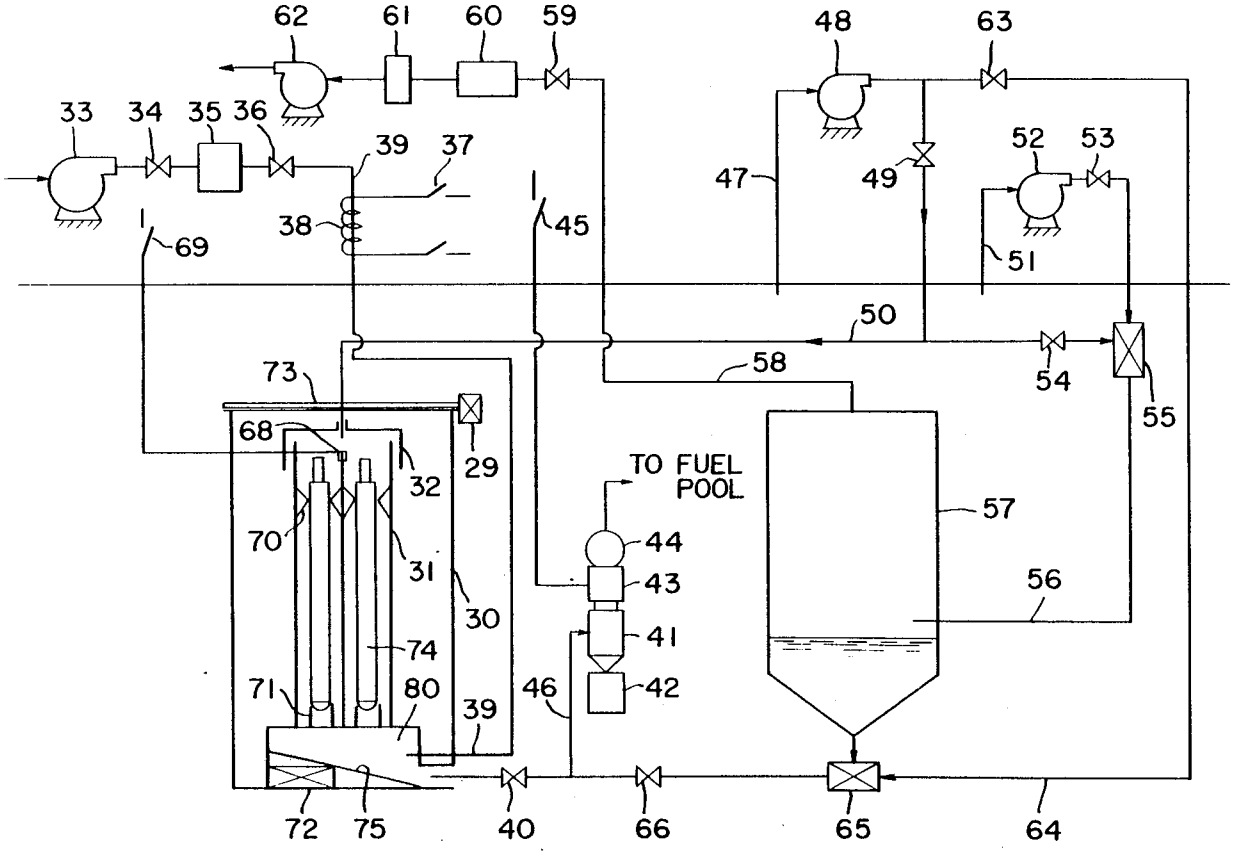
FIG. 2 is a connection diagram showing one embodiment of the apparatus of this invention.
Figure 3:
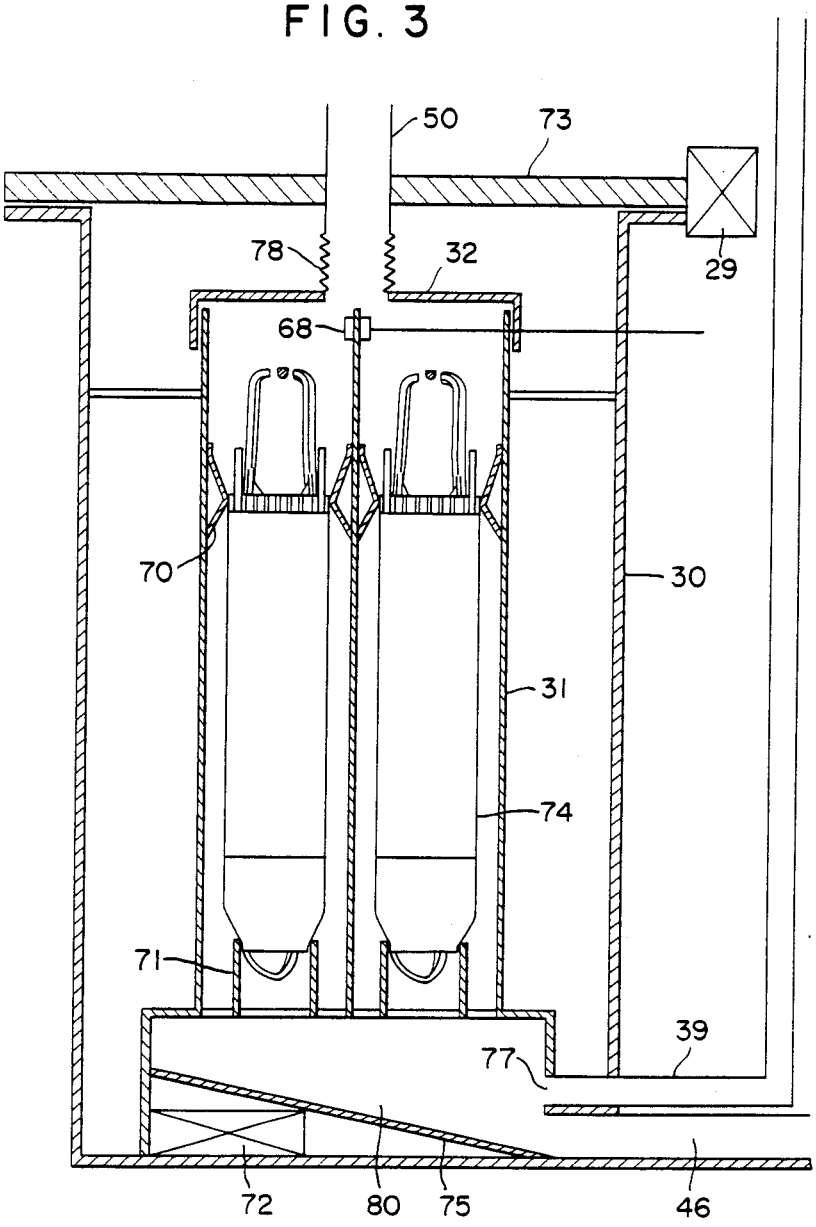
FIG. 3 is a transverse sectional view showing the detail of a drier tank.

A preferred embodiment of this invention will now be described with reference to FIGS. 2 and 3.

As shown, a drier tank 30 is provided with an upper cover 73 opened and closed by an automatic cover operating device 29. Inside the drier tank 30 is positioned a vertical tank 31 which, in this example, contains two fuel rod assemblies 74 that are held in the vertical position by shaped leaf springs 70 and the lower ends of the fuel rod assemblies 74 are supported by tubular pedestals 71 opened in a lower plenum chamber 80. The plenum chamber 80 is divided into two compartments by an inclined partition plate 75. An electromagnetic vibrator 72, for example, is disposed in the lower compartment to impart vibration to the fuel rod assemblies to enhance peeling off of the scale deposited on the sheaths of the fuel rods. A blower 33 is provided to supply gas (in this example air) through valves 34 and 36, a reservoir tank 35, a pipe 39 and its opening 77 into the upper compartment of the plenum chamber 80. The upper end of the tank 31 is closed by a removable lid 32 which is connected to a pipe 50 through a bellows 78. The pipe 50 is normally closed by valves 54 and 49 as will be described later.

When it is desired to remove scale deposited on the fuel rod sheaths, the fuel rod assemblies 74 are dismounted from the reactor core and cooled in a fuel pool, not shown, to substantially room temperature. The fuel rod assemblies 74 taken out of the fuel pool and put into the tank 31 are still wet. Under these conditions, the scale deposited on the fuel rod sheaths is sludgy or paste like and does not readily peel off. When gas is supplied into the tank 31 and caused to circulate therein, the water is separated and drops onto the inclined plate 75. Then the scale dries, cracks to peel off the sheaths and drops onto the inclined partition plate 75. Since fissionable element is contained in the sheaths, the paste like scale is heated to a temperature sufficient to dry by the heat of nuclear fission. However, as will be described later, to completely remove the scale it is advantageous to alternately dry the scale with gas and wet with water. To this end a portion of the gas pipe 39 is surrounded by an electric heater 38 which is energized through a switch 37 to heat the gas to a temperature to about 40°-100° C. The temperature of the gas in the tank 31 is measured by a thermocouple 68, for example, and displayed by a thermometer 69.

Although the temperature of the gas is not critical, for the purpose of quickly removing water and converting sludgy scale into readily separable powder form, it is advantageous that the temperature is higher than room temperature, preferably higher than 40° C.

A mixture of water and removed scale collected in the upper compartment of the prenum chamber 80 is sent to a water-scale separator 41 where the scale is collected in a cyclon collector 42, while the water separated is returned to the fuel pool, not shown, through a back filter 44 by a pump 43 energized by a switch 45.

A gas-water separator 57 is supplied with water in the fuel pool by a water pump 52 via pipes 51 and 56, a valve 53 and an ejector 55. When water passes through the ejector 55, a negative pressure is created to draw the gas in the tank 31 via pipe 50 and valve 54. The drawn out gas is discharged into the gas-water separator 57 through pipe 56 together with the water passing through the ejector 55.

The gas in the gas-water separator 57 is discharged to the outside, in a harmless state, by a pump 62 via a pipe 58, a valve 59, a water remover 60 and a dust filter 61 which removes harmful dust which may remain in the gas. The water in the gas-water separator 57 is sent to the water-scale separator 41 via pipe 46, valve 66 and an ejector 65. The water in the fuel pool is passed through the ejector 65 by a pump 48 through a pipe 47, a valve 63 and a pipe 64. When the water is passed through the ejector 65 a negative pressure is created to discharge the water in the gas-water separator 57 to the water-scale separator 41. A valve 49 is connected between pipes 50 and 64 for the purpose to be described later.

The apparatus shown in FIGS. 2 and 3 operates as follows. At first, the fuel rod assemblies 74 taken out of the fuel pool are contained in the tank 31 in the drier box 30 and then the cover 73 and lid 32 are closed as shown. Then, valves 34, 36 and 40 are opened, valves 54 and 49 are closed, and the blower 33 is started to supply gas into the tank 31. The gas in the tank 31 is heated by the heat of nuclear fission of the fuel rod or by the electric heater 38 to dry and separate paste shaped scale deposited on the fuel rod sheaths. The gas in the tank 31 circulates therein automatically, or if desired a fan or blower, not shown, may be provided to circulate the gas through the tank 31 to more uniformly heat the fuel rod assemblies 74. Water and scale thus separated fall down onto the inclined plate 75 and are then conveyed to the water-scale separator 41 via pipe 46 and valve 40. The radioactive scale is collected by the cyclon collector 42 and then discarded in a well known manner, while the water separated is returned to the fuel pool through the back filter 44 by the pump 43. When the vibrator 72 is operated during the step described above the removal of the dried scale is enhanced.

In the second step, valve 40 is closed, valves 53 and 54 are opened, and the pump 52 is started to supply the water in the fuel pool to the gas-water separator 57 via the ejector 55, the negative pressure created therein being used to discharge the gas in the tank 31 into the gas-water separator 57 in a manner as above described.

Then, the pump 62 is started and the valve 59 is opened to discharge gas in the gas-water separator 57 into the surrounding atmosphere after removing any radioactive water particles or dust of scale by water separator 60 and dust filter 61.

After completing the first and second steps all pumps are stopped and all valves are closed and the pipe 50 is disconnected from the drier box 30. Then, the cover 73 and lid 32 are opened to take out cleaned fuel rod assemblies 74, and new wet fuel rod assemblies 74 are loaded in the tank 31 to start the next scale removing cycle.

However, when the more quick and complete removal of the scale is desired, after completing the first and second steps the following third and fourth steps are performed.

More particularly, at the third step following the second step, blower 33, pumps 52 and 62, and electric heater 38 are deenergized, and valves 34, 36, 53, 54 and 59 are closed to stop flow of gas through the tank 31. Then, valves 40 and 49 are opened and pumps 48 and 43 are operated to sprinkle the water in the fuel pool upon the fuel assemblies 74 via pipes 47, 50, pump 48 and valve 49, thereby conveying downward the separated scale and discharging a mixture of scale and water collected in the plenum chamber 80 to the water-scale separator 41.

Then, at step 4, the pump and blower utilized at step 3 are stopped, and valves opened at step 3 are closed. Then, valves 63 and 66 in pipe 64 are opened, and pumps 43 and 48 are started to supply water to the water-scale separator 41 through pipes 47, 64 and 46 and the ejector 65. As has been described hereinbefore, due to the negative pressure created in the ejector 65 the water in the gas-water separator 57 is discharged to the water-scale separator 41 and then returned to the fuel pool by the pump 43 through the back filter 44.

As above described, according to this invention it is possible to quickly and positively remove radioactive scale deposited on the fuel rod sheaths by merely heating the fuel rod assembly in gas heated to a temperature higher than room temperature. Although the heat necessary to heat the gas can be obtained by the nuclear fission of the fuel rod, it is advantageous to use an external heater such as an electric heater. In order to enhance evaporation of water contained in the scale, it is advantageous to remove moisture from the gas before it is admitted into the tank 31.

I claim:

1. Apparatus for removing scale which is deposited on a nuclear fuel rod assembly during operation of said nuclear fuel rod assembly in a boiling water type nuclear reactor, comprising a substantially sealed tank in which said nuclear fuel rod assembly is disposed, means for wetting said scale with water while said fuel rod assembly is within said tank, means for filling said tank with a gas heated to a temperature higher than room temperature for drying and peeling off said scale from said nuclear fuel rod assembly, and means connected to a bottom portion of said tank for separating peeled off scale and water discharged from said tank.

2. The apparatus according to claim 1 wherein said tank is vertical and provided with a removable lid at its top end and spring means for holding in position said fuel rod assembly.

3. The apparatus according to claim 1 which further comprises an inclined plate located in the bottom portion of said tank for collecting peeled off scale and water to facilitate discharge of a mixture of said scale and water.

4. The apparatus according to claim 1 which further comprises means for supplying from outside said gas into said tank.

5. The apparatus according to claim 4 which further comprises means for heating said gas before it is admitted into said tank.

6. The apparatus according to claim 1 which further comprises means for imparting vibration to said fuel rod assembly contained in said tank.

7. Apparatus for removing scale which is deposited on a nuclear fuel rod assembly during operation of said nuclear fuel rod assembly in a nuclear reactor, comprising a substantially sealed vertical tank in which said nuclear fuel rod assembly is disposed, means for wetting said scale with water while said fuel rod assembly is within said tank; means for filling said tank with a gas heated to a temperature higher than room temperature for drying and peeling off said scale from said nuclear fuel rod assembly, means connected to a bottom portion of said tank for separating peeled off scale and water discharged from said tank; and means for spraying water onto said nuclear fuel rod assembly in said tank after said scale has been removed.

8. The apparatus according to claim 7 wherein said peeling off of said scale with the heated gas and spray of water are alternately performed for a predetermined number of cycles.

9. The apparatus according to claim 7 which further comprises a gas-water separator, means for supplying water to said gas-water separator, and means passed by said water supplied to said gas-water separator for creating a negative pressure effective to remove said gas from said tank and to discharge the removed gas into said air-water separator.

10. The apparatus according to claim 9 wherein said means for creating said negative pressure comprises an ejector.

11. The apparatus according to claim 9 which further comprises means for discharging gas in said air-gas separator to the outside, said gas discharging means including a water separator and a gas filter.

12. The apparatus according to claim 9 which further comprises means for supplying water to said scale-water separating means through means for creating a negative pressure effective to discharge water in said gas-water separator to said scale-water separating means.

13. The apparatus according to claim 12 wherein said means for creating said negative pressure comprises an ejector.

* * * * *